United States Patent [19]

Finch

[11] Patent Number: 4,513,497

[45] Date of Patent: Apr. 30, 1985

[54] TUBE EXPANDING SYSTEM

[75] Inventor: Curtis L. Finch, Lynchburg, Va.

[73] Assignee: The Babcock & Wilcox Company, New Orleans, La.

[21] Appl. No.: 655,985

[22] Filed: Sep. 27, 1984

Related U.S. Application Data

[63] Continuation of Ser. No. 445,609, Nov. 30, 1982, abandoned, which is a continuation of Ser. No. 156,543, Jun. 5, 1980, abandoned.

[51] Int. Cl.[3] ..... B23P 15/26; B21D 39/08

[52] U.S. Cl. ..... 29/727; 72/54; 72/58; 72/62

[58] Field of Search ..... 29/157.3 R, 157.4, 421 R, 29/446, 523, 727, 761; 72/54, 56, 58, 61, 62, 63

[56] References Cited

U.S. PATENT DOCUMENTS

| | | | |
|---|---|---|---|
| 2,337,247 | 12/1943 | Kepler | 29/446 X |
| 2,945,527 | 7/1960 | Bower et al. | 72/3 |
| 4,047,277 | 9/1977 | Burk | 72/56 X |
| 4,055,063 | 10/1977 | Krips et al. | 72/62 |
| 4,069,573 | 1/1978 | Rogers et al. | 29/421 R |
| 4,195,390 | 4/1980 | Amen | 29/421 R |
| 4,214,923 | 7/1980 | Price | 72/56 X |
| 4,332,073 | 6/1982 | Yoshida et al. | 29/421 R |
| 4,364,251 | 12/1982 | Nishihara et al. | 72/58 |

*Primary Examiner*—E. Michael Combs

*Attorney, Agent, or Firm*—James C. Simmons; D. Anthony Gregory; Robert J. Edwards

[57] ABSTRACT

A tube expanding technique for securing a sleeve within a tube whereby fluid pressure is applied via an expander by incrementally decreasing the volume of the fluid system exclusive of the expander, or by incrementally increasing the mass of the fluid within the system. The system pressure and the rate of pressure increase as a function of incremental change in volume, or mass, are monitored. A decrease in the rate is indicative of the onset of plastic expansion of the sleeve or tube, as the case may be. By determining this point, the outer diameter of the tube may be accurately controlled to within six thousandths of an inch. A tube expanding device including a distensible sealed bladder for applying the expanding pressure and containing the system fluid.

18 Claims, 3 Drawing Figures

TUBE EXPANDING SYSTEM

This application is a continuation of application Ser. No. 445,609, filed Nov. 30, 1982, abandoned which prior application is a continuation of application Ser. No. 156,543, filed June 5, 1980 abandoned.

BACKGROUND

The present invention relates to tube expansion, and more particularly to controlled expansion of a tube within a tube sheet or within another tube using a pressurized fluid system.

Steam generators used in commercial nuclear power plants are heat exchangers including a vessel containing a large number of stainless steel tubes affixed at their ends to tube sheets. In some steam generators, namely, the "U-tube" type, the tubes are formed in the shape of a "U" with both ends affixed to a single tube sheet. In other steam generators, namely, the "once-through" type, the tubes are straight and affixed between two separate tube sheets. Typically, heated radioactive high pressure reactor core primary coolant is directed through the tubes. A relatively cool, low pressure secondary coolant, typically water, is pumped through the steam generator around the hot tubes to thereby gain heat and to vaporize into steam, thus the name "steam generator." The steam generator tubes are exposed to a hostile atmosphere of undesirable chemicals, temperatures and temperature gradients that result in the degradation of the tubes' integrity. For example, corrosive chemical action that occurs during alternate wetting and drying of the tube surface in a vapor-liquid mixture atmosphere leads to a failure mechanism known as stress-corrosion cracking. Another mechanism leading to tube failure is vibration induced errosion.

However, regardless of how the steam generator tube fails, the result is a leak and a flow of radioactive high pressure primary coolant into the low pressure secondary coolant. A certain number of these leaks are tolerable. However, when leakage occurs to the extent that the secondary coolant becomes unacceptably radioactive it becomes necessary to replace or plug the tubes. In that replacing tubes is a difficult operation, especially in the case of the U-tube type steam generator, the tubes are typically plugged. Unfortunately, as more tubes are plugged, the capacity of the steam generator is decreased. Eventually, the capacity of the steam generator will be decreased to such a degree that large scale overhaul is required.

The foregoing inevitability can be circumvented to some extent by stiffening the tubes in the vicinities of defects before the defects become leaks. Hereinafter, a "defective tube" is defined as a tube having a degraded wall thickness but not a leaking tube. It may be desirable to plug the tube rather than stiffening it once the defect has surpassed 40% of the wall thickness. Defective tubes can be identified by known tube inspection techniques. Furthermore, as a precautionary measure it is desirable to stiffen tubes in areas of the steam generator which experience high fluid velocities where the likelihood of vibration induced erosion is increased.

To stiffen the tubes, typically, a sleeve of sufficient length to cover the defect and to allow expansion of the sleeve into the tube above and below the defect is inserted within the tube and positioned at the defect location. The sleeve and tube are then expanded above and below the defect to hold them together and thereby stiffen the defective portion of the steam generator tube.

Several methods and devices are available in the prior art for expanding the sleeve within the tube. Rogers, Jr. et al (U.S. Pat. No. 4,069,573) described a hydraulic tube expander that applies fluid pressure to the inside of the sleeve to expand it into the steam generator tube. Hereinafter, the term "hydraulic" expander refers to an expander utilizing fluid (liquid or gas) pressure to effect expansion. In Rogers, Jr. et al, a set expansion pressure is first applied within the fixed tube, then an additional fixed volume of fluid is forced into the system volume. This method and device suffer from several drawbacks. First, the fluid is applied directly to the inside of the sleeve. This requires a good seal between the expander device and the sleeve, thus, an accurate sizing of the sleeve's inside diameter is critical. Also, the sleeve's inside surface must be extremely smooth. These requirements add significantly to the sleeve cost. Second, this device spills undesirable fluid into the steam generator necessitating clean-up and repriming of the apparatus before the next expansion. Third, the method of applying a fixed fluid pressure followed by a fixed volume input results in a steam generator tube outside diameter increase which is controllable to within about 0.025 inches. This degree of expansion control is not acceptable if the tubes are ever to be withdrawn from the tube sheets for replacement i.e., when enough tubes are damaged to so warrant rebuilding of the steam generator. An expansion of 0.025 inches will preclude withdrawal of the tube without an unacceptable risk of damage to the tube sheet. This is a particular problem in the once through steam generator wherein the only way to remove the tube is through a tube sheet. An acceptable degree of steam generator tube outer diameter expansion control is about 0.006 inches or less, which will allow withdrawal of the steam generator tubes through the tube sheet.

The reason the method of the prior art cannot achieve the desired expansion control is that, because of variance in the dimension and yield strengths of the sleeves and the tubes, one cannot calculate what fluid pressure to apply to the system or volume of fluid to inject into the system, unless the dimensions and yield strengths of the particular sleeve and tube undergoing expansion are known. Unfortunately, these values vary due to manufacturing tolerances and in-service material property transitions. Each case is different. Treating each expansion uniformly as in the prior art limits control of the steam generator tube outer diameter to about within 0.025 inches. Therefore, one cannot calculate the fluid pressure, or volume of fluid introduced to the system or decrease in system volume, or predetermine a distance to expand based on test specimens and then proceed willy-nilly expanding hundreds of tubes in a nuclear steam generator. Unless, of course, one can accept the degree of control that results.

Similarly, the compressable elastomer device of Rogers, Jr. et al., is, in fact, incapable of controlled expansion of the tube to within 0.006 inches.

The present invention overcomes these disadvantages of the prior art. Fluid pressure is used to expand a distensible polyurethane bladder within the sleeve to expand the sleeve into the tube. The fluid is contained at all times within the bladder, thus there is no spillage and no need for repriming of the expander system.

The degree of expansion of the steam generator tube outer diameter is controlled within 0.006 inches by determining in each case exactly when the steam generator tube begins to yield. This is accomplished by monitoring the change in pressure (dP) of the fluid as a function of the change of the volume (dV) of the fluid system exclusive of the distensible bladder. It is most important to note here that dV represents the volume of the fluid system *exclusive* of the distensible bladder. According to one embodiment of the invention, the change in pressure, dP, of the system fluid is compared to the change in volume dV. The fluid pressure, P, of the system, will increase linearly relative to dV until the yield point pressure of the sleeve material is reached. As the sleeve yields, the pressure increases at a slower rate relative to dV since the bladder is distending, thus adding volume to the total system and lessening the net decrease in the total volume of the system inclusive of the bladder volume. When the sleeve contacts the inside surface of the steam generator tube, the pressure will increase at a higher rate with respect to dV until the yield strength of the steam generator tube is reached. Again, when the pressure begins to increase at a slower rate with respect to dV the steam generator tube has begun to yield and expand. This is the critical point. The variance of dimensions and material properties of the steam generator tube and the sleeve precludes precise calculation of this point using the prior art methods. By monitoring the pressure rate of change with respect to dV according to the present invention, this point where the steam generator tube begins to yield can be determined with precision in each and every case. In this way, the expansion of the steam generator tube outer diameter can be controlled to within the 0.006 inch tolerance.

In another embodiment, rather than incrementally decreasing the volume of the fluid system, a mass pump adds an incremental fluid mass, dM, to a fluid system having a fixed fluid volume (fixed volume exclusive of the expansion area, as discussed above). Hereinafter a "volume pump" is defined as a positive displacement pump which acts to increase or decrease pressure of a fluid system by controllably effecting the volume of the fluid system. Hereinafter a "mass pump" is defined as a positive displacement pump which acts to increase or decrease the pressure of a fluid system by controllably effecting the mass of the fluid system. Whether a volume pump or a mass pump is used, the fluid system pressure is monitored as a function of the pump incremental action to determine the onset of plastic deformation of the sleeve and tube.

It is an object of the present invention to provide a method of controllably expanding tubes within a 0.006 inch limit.

It is a further object of the present invention to provide a method having the foregoing advantage and which determines the yield point of the tube on a case-by-case basis.

It is a further object of the present invention to provide a hydraulic tube expander utilizing an expandable bladder to thereby contain the hydraulic fluid to prevent fluid spillage and eliminate the need to clean the steam generator or to reprime the apparatus between expansions.

Other objects and advantages of the present invention will be readily apparent from the following description and drawings which illustrate preferred embodiments of the present invention.

SUMMARY OF THE INVENTION

The present invention involves a method and apparatus for hydraulic tube expansion. In the method, a sleeve is expanded within a tube and secured there to by incrementally decreasing the volume of the expander system fluid exclusive of the expander which will inherently experience an increase in fluid volume as it expands. The rate of system pressure increase in monitored as a function of incremental volume change. Two critical rate decreases occur during use of the apparatus. The first decrease indicates the onset of plastic expansion of the sleeve. The second decrease indicates the onset of plastic expansion of the tube. The tube outer diameter can be expanded accurately to within six thousandths of an inch (0.006 inch). Alternative to decreasing the system volume the fluid system mass can be incrementally increased with the same results. In the apparatus, system fluid is contained within a sealed distensible bladder expander.

DETAILED DESCRIPTION OF THE PREFERRED EMBODIMENTS

Figure 1:
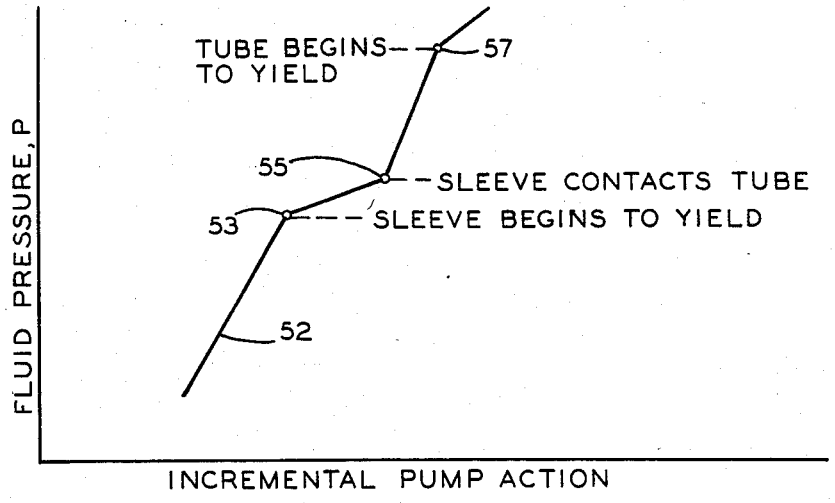
FIG. 1 is a graph illustrating the method of the present invention.
Figure 2:
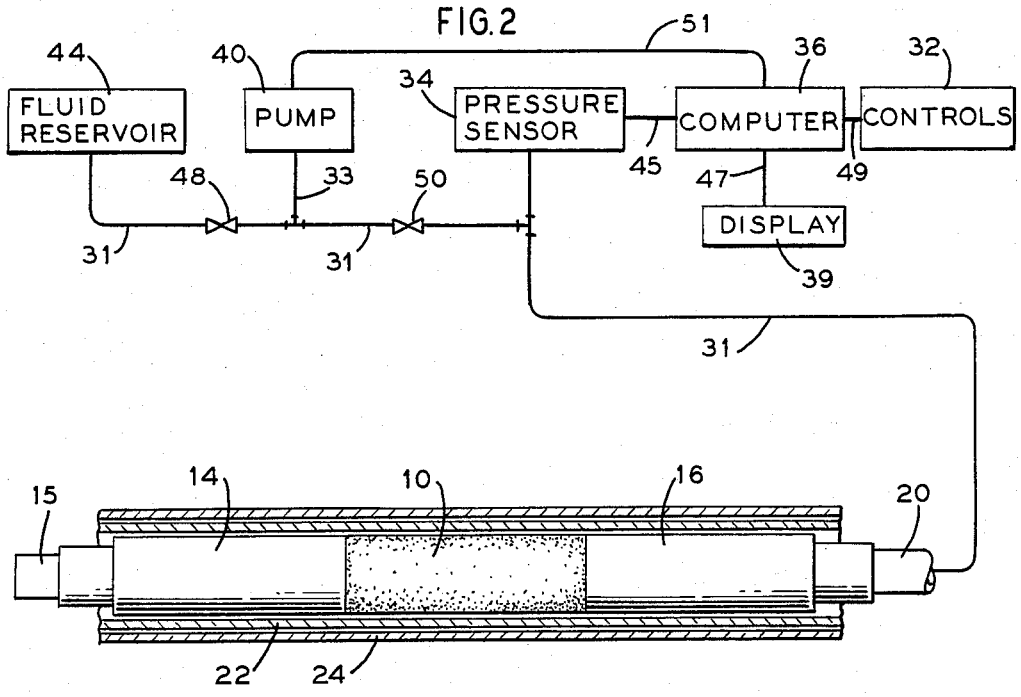
FIG. 2 is a schematic view of a hydraulic tube expanding system according to the present invention.

Refer now to FIG. 1 there being shown a graph illustrating the method according to the present invention. Plotted in FIG. 1 is the system fluid pressure as a function of incremental pump action. Pump 40 (FIG. 2) is a volume pump which incrementally decreases the volume of a fluid chamber (not shown) therein. Alternatively pump 40 may be a mass pump which incrementally increases the fluid system mass. FIG. 2 represents both embodiments with pump 40 being either a volume pump or a mass pump. The end result is the same as it will become clear from the following description.

First consider the utilization of a volume pump. In operation, the incremental decrease in pump volume causes two related effects: (1) an increase in system pressure, and (2) an expansion of the repair sleeve and steam generator tube. Obviously, the less the sleeve and tube expand to thereby add volume to the total fluid system, the greater the increase in pressure per incremental volume decrease of the system exclusive of the expander. The fluid system pressure is indicative of the relative resistance to sleeve and tube expansion. As the sleeve and tube expand elastically the resistance to expansion is relatively high. As pressure is increased and the sleeve and tube yield points are reached the sleeve and tube begin to expand plastically and the resistance to expansion is relatively low.

Curve 52 of FIG. 1 illustrates the expansion of a repair sleeve within a tube. As the pump incrementally decreases the fluid volume of the system, the fluid is compressed, the system fluid pressure increases, and the sleeve is expanded elastically. At point 53 the sleeve material reaches the yield point. Between point 53 and point 55 the sleeve expands plastically. The slope of curve 52 between points 53 and 55 has decreased because the sleeve's resistance to expansion has decreased. As the sleeve expands, volume is thereby added to the total fluid system in the vicinity of the expander (although net system volume is being decreased by the pump action.) More volume is added due to sleeve expansion during plastic deformation per incremental volume decrease in the pump (or in the system exclusive of the expander), dV, than is added during elastic deformation of the sleeve. The net effect is a relatively lower *total* system volume decrease per incremental volume decrease in the pump during plastic deformation then during elastic deformation of the sleeve. The system fluid pressure is inversely proportional to the system fluid volume (assuming, of course, that a constant fluid mass is maintained).

At point 55 the sleeve contacts the tube. Curve 52 between points 55 and 57 represent the elastic expansion of the tube. At point 57 the tube begins to yield and expand plastically. Points 53 and 57 will not always occur at the same pressure. Each tube and sleeve are different in material dimensions and properties. By determining point 57 from each and every expansion the increase in the tube outside diameter can be maintained within 0.006 inches for typical steam generator size tubes. Curve 52 above point 57 represents the plastic expansion of the tube and sleeve.

Turn now to FIG. 2, there being shown a tube expander system according to the present invention. In FIG. 2 sleeve 22 is to be expanded into steam generator tube 24. The expanding apparatus, explained below in more detail, includes a distensible polyurethane bladder 10. Bladder 10 and sleeve 22 are appropriately positioned for the expansion. This is easily accomplished by first expanding bladder 10 to hold sleeve 22 and then inserting them both into tube 24. Fluid supply conduit 31 establishes fluid communication from reservoir 44 to expander supply tube 20. Control volume (or control mass) pump 40 is in fluid communication with conduit 31 via conduit 33. Pump 40 incrementally decreases the volume of a chamber therein (not shown). The chamber is in fluid communication with conduit 33. Valve 48 is positioned on conduit 31 between reservoir 44 and conduit 33. Valve 50 is positioned in conduit 31 between conduit 33 and expander supply tube 20. Pressure sensor 34 senses the fluid pressure within conduit 31 and generates a signal through cable 45 to computer 36. Computer 36 is programmed to generate a signal through cable 47 to display 39 which displays the pressure as a graph according to FIG. 1. Controls 32 enable an operator (not shown) to instruct and control computer 36 by communicating therewith via cable 49. Computer 36 generates a signal to pump 40 through cable 51 to incrementally decrease the fluid volume of the system (or incrementally increase the mass). Computer 36 is programmed to monitor the incoming pressure signal as a function of incremental pump action (volume decreases or mass increase) and to indicate via display 39 a change in slope of the curve thereby enabling precise detection of the onset of plastic deformation of sleeve 22 and tube 24.

To explain operation in further detail a typical set of dimensions will be given as follows.

Steam generator tube outside diameter: 0.627 inches
Steam generator inside diameter: 0.551 inches
Sleeve outside diameter: 0.525 inches
Sleeve inside diameter: 0.430 inches Also, Pump 40 decreases the volume of its chamber with an accuracy finer than 0.001 cubic inches. Total system volume is approximately 0.5 cubic inches.

To begin the procedure, valve 50 is closed and valve 48 is open. Pump 40 is turned on and draws fluid into its chamber. Valve 48 is now closed and valve 50 opened. Pump 40 now acts to increase the system pressure to expand bladder 10 enough to grip sleeve 22. Air can be removed from the fluid system by bleeding at plug 15 (FIG. 3) if desired but if not, the operation of the system will not be affected. The fluid of the preferred embodiment is glycerin.

Sleeve 22 is positioned in tube 24 at the location to be stiffened. Pump 40, under the direction of computer 36 begins to decrease its chamber volume. At a volume decrease of, for example, 0.175 cubic inches and system pressure of for example, 11,000 pounds per square inch (PSI) sleeve 22 yields and begins plastic deformation. This is represented by point 53 of FIG. 1. Computer 36 senses the change in slope of the curve 52 as explained above in regards to FIG. 1 and stops pump 40.

The operator (not shown) views display 39 and instructs computer 36 via control 32 to proceed. Pump 40 is reactivated. At a total volume decrease of, for example, 0.200 cubic inches and a pressure of, for example, 14,000 PSI, computer 36 senses another slope change as sleeve 22 contacts tube 24. This occurrance is represented by point 55 of FIG. 1. At this point sleeve has been expanded 0.010 to 0.030 inch. At a volume decrease of, for example, 0.236 cubic inches and a pressure of, for example, 21,000 PSI, computer 36 senses another slope change as tube 24 begins to yield. This is represented by point 57 of FIG. 1. Pump 40 is deactivated. At this point tube 24 has increased its outer diameter by about 0.002 inches.

Two phenomena of materials are worth noting here. First, when the tube is expanded "plastically" it is not truly plastic deformation. The material maintains elastic characteristics to a certain degree. The second phenomenon is that as the tube is expanded it is "work-hardened" and becomes more elastic and less plastic. The pertinent effect of these phenomena is that when the expanding force is relieved the material will spring back somewhat. This effect is on the order of 0.001 inches of outside diameter in the present example.

Once yield point 57 has been determined, the remainder of the expansion is accurately predicted. In the present example a further decrease in pump volume to 0.244 cubic inches decrease total yields tube 24 to 0.006 inches outside diameter increase, or 0.633 inches total outside diameter. Relieving the expanding pressure, tube 24 springs back to 0.632 inches, a resulting 0.005 inch increase. The expansion is sufficient to adhere sleeve 22 to tube 24 but not enough to preclude subsequent removal of steam generator tube 24 through the tube sheet (not shown).

Of course, the ends of sleeve 22 are expanded both below and above the area of degradation of tube 24, to effectively stiffen the tube.

As noted, the above described embodiment pertains to a volume control pump 40 that incrementally decreases the volume V of the system exclusive of the bladder. Alternatively, fluid mass could be incrementally added to the system with control mass pump 40 while maintaining a constant volume, V, with the same results. System pressure is maintained as a function of incremental pump action. In the case of a control mass pump, this incremental action represents the increase in system mass while a constant system volume exclusive of the expander, is maintained. The method as hereinbefore discussed is the same, regardless of the use of a control mass pump or a control volume pump.

Figure 3:
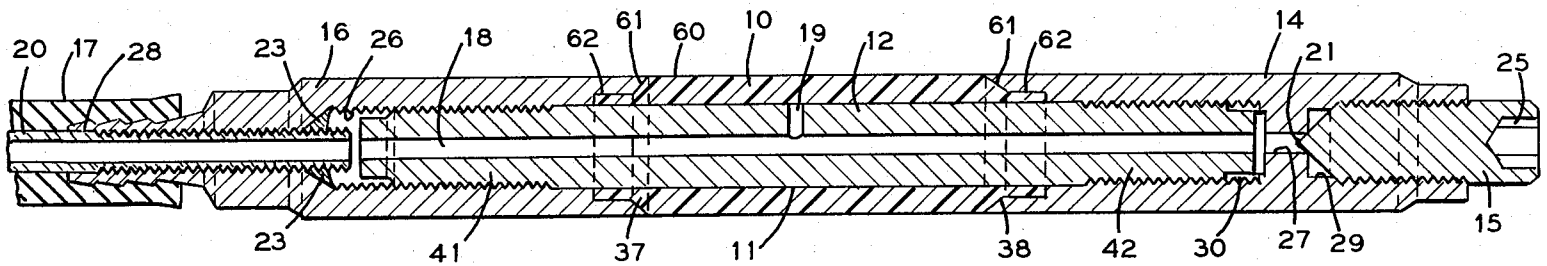
FIG. 3 is a cross section view of the hydraulic tube expander according to one embodiment of the invention.

Turn now to FIG. 3 wherein a cross-section view of a tube expander according to the present invention is shown. Distensible bladder 10 is a hollow polyurethane cylinder having a bladder tubing end 37 and a bladder plug end 38. The inside diameter of bladder 10 defines chamber 11. Bladder 10 has a first outside diameter 60 for its midsection, and a decreasing diameter 61 to a smaller second outside diameter 62 at ends 37 and 38. Ends 37 and 38 having decreasing diameter 61 and second diameter 62 serve to be self sealing to prevent leakage of fluid. As fluid pressure increases, ends 37 and 38 are forced against mating surfaces of tubing endfitting 16 and plug endfitting 14 thereby sealing bladder 10. Decreasing diameter 61 is provided to prevent shearing of the midsection of bladder 10 from ends 37 and 38. Bladder 10 is reasonably elastic and has a high tensile strength. Polyurethane having a hardness between 60 on the Shore A scale and 75 on the Shore D scale is acceptable. In the preferred embodiment a polyurethane of 92 Shore A is used. Also the tensile strength of bladder 10 should be greater than about 5,000 PSI. In the preferred embodiment bladder 10 has a tensile strength of 6,200 PSI. Other elastic materials, elastomers, or synthetic rubbers may be used.

Stud 12 extends through chamber 11 and protrudes from both ends 37 and 38. The protruding stud tubing end 41 and stud plug end 42 of stud 12 are threaded. First bore 18 extends longitudinally through stud 12. Second bore 19 extends from the surface of stud 12 to bore 18 to establish fluid communication between bore 18 and chamber 11. Tubing endfitting 16 has a longitudinally extending tubing endfitting stud bore 26 threaded to accept stud tubing end 41, and a longitudinally extending tube bore 28 threaded to accept the end of threaded supply tube 20. Tube 20 extends through tube bore 28 and protrudes into tubing endfitting stud bore 26. Tube 20 may be soldered to tubing endfitting 16 with solder 23 if desired, but this is not necessary if supply tube 20 and tubing endfitting 16 are properly threaded. Pliable nylon tube 17 serves to protect tube 20 extending therethrough.

Plug endfitting 14 has longitudinally extending plug endfitting stud bore 30 threaded to accept stud plug end 42, longitudinally extending plug bore 29 threaded to accept plug 15, and bleed bore 27 establishing fluid communication between plug endfitting stud bore 30 and plug bore 29.

Plug 15 has hex socket 25 and tapered point 21. Point 21 seats in bore 27. Plug 15 can be removed for bleeding the fluid system if desired. Bores 26 and 30 of the endfittings 16 and 14 respectively have an inside diameter formed to mate with ends 37 and 38 of bladder 10. Actually, an interference fit is desirable to effect a better seal.

Upon assembling the apparatus as shown in FIG. 3, bladder 10 is sealed by endfittings 14 and 16 and stud 12. The fluid path extends from supply tube 20 to chamber 11 of bladder 10 via bores 26, 18 and 19.

It should be noted that alternatively more than one bladder could be utilized with an extending fitting positioned therebetween. However, there would be a resulting decrease in the controllability of the expansion due to the sleeve and tube property variance between the two points being expanded.

Although computer 36 is utilized, adding to the precision of the system, the invention is not limited thereto. Manual control of the system will yield equally effective results.

The above description and drawings are only illustrative of one embodiment which achieves the objects, features and advantages of the present invention, and it is not intended that the present invention be limited thereto.

Any modification of the present invention which comes within the spirit and scope of the following claims is considered part of the present invention.

What is claimed as new and desired to be secured by Letters Patent of the United States is:

1. A tube expanding system comprising: a hydraulic tube expander including distensible bladder means positionable within a tube; pump means for pressurizing fluid within said bladder means; means for monitoring changes in the fluid pressure within said bladder means; and means for detecting from the monitored pressure changes a decrease in the rate of fluid pressure increase, as a function of incremental action of said pump means, indicative that the yield point of the tube is reached whereby the increase in outside diameter of a tube within which a sleeve is expanded may be accurately limited by ceasing pressurizing of fluid within the bladder means when the yield point of the tube is reached.

2. A tube expanding system as in claim 1 wherein said bladder means is distensible only in the radial direction relative to the tube.

3. A tube expanding system as in claim 1 wherein said bladder means includes:

a distensible bladder having a chamber;

sealing means for sealing said bladder to preclude the escape of fluid from the chamber thereof.

4. A tube expanding system as in claim 3 wherein:

said bladder is a cylinder having a bladder tubing end and a bladder plug end;

said tubing end and said plug end having inwardly tapered outer diameters;

said chamber extending longitudinally through said bladder;

said sealing means includes an elongated cylindrical stud extending through said chamber, said stud having a threaded stud tubing end and a threaded stud plug end, a first bore extending longitudinally therein from said stud tubing end, a second bore extending from said first bore to the surface of said stud between said bladder tubing end and said bladder plug end to establish fluid communication between said stud tubing end and said chamber via said first bore and said second bore, a tubing endfitting having a tubing endfitting stud bore being threaded to engage said threaded stud tubing end and a tube bore in fluid communication with said tubing endfitting stud bore being threaded to engage a fluid supply tube to establish fluid communication between said fluid supply tube and said stud tubing end, said tubing endfitting stud bore being outwardly tapered to mate with the outer diameter of said bladder tubing end, a plug endfitting having a plug endfitting stud bore being threaded to engage said threaded stud plug end, said plug endfitting stud bore being outwardly tapered to mate with the outer diameter of said bladder stud end, said tubing endfitting and said plug endfitting being screwed onto said stud to mate with said bladder tubing end and said bladder plug end respectively to seal said chamber.

5. A tube expanding system as in claim 4 wherein:

said first bore extends through said stud;

said plug endfitting includes a threaded plug bore in fluid communication with said plug endfitting bore and a threaded plug screwable into said plug bore to seal said plug bore.

6. A tube expanding system as in claim 4 wherein said bladder, said tubing endfitting and said plug endfitting have equivalent outer diameters.

7. A tube expanding system as in claim 1 wherein said fluid pressurizing means comprises volume pump means in fluid communication with said bladder means for incrementally decreasing the volume of fluid in the system exclusive of the expander while a constant fluid mass is maintained in the system, and said monitoring means includes indicating means for indicating the fluid pressure in the system.

8. A tube expanding system as in claim 1 wherein said fluid pressurizing means comprises mass pump means in fluid communication with said bladder means for incrementally increasing the mass of fluid in the system while maintaining a constant volume in the system exclusive of the expander, and said monitoring means includes indicating means for indicating the fluid pressure in the system.

9. A tube expanding system as in claim 1 wherein the increase in outside diameter of the tube is limited to 0.006 inch by ceasing pressurizing of fluid within the bladder means when the yield point of the tube is reached.

10. A tube expanding system as in claim 1 further comprising means responsive to a signal from said monitoring means indicating when the yield point of the tube is reached for ceasing pressurizing of fluid within the bladder means.

11. A tube expanding system as in claim 10 wherein said means for ceasing pressurizing of fluid within the bladder means is effective to limit the increase in outside diameter of the tube to 0.006 inch.

12. A tube expanding system as in claim 1 wherein said fluid pressurizing means comprises a fluid reservoir, a fluid conduit establishing fluid communication between said fluid reservoir and said hydraulic tube expander, a pump in fluid communication with said fluid conduit, a first valve for selectively closing said fluid conduit positioned between said fluid reservoir and said pump, and a second valve for selectively closing said fluid conduit positioned between said pump and said hydraulic tube expander, and wherein said monitoring means includes means for sensing and indicating the fluid pressure between said first valve and said hydraulic tube expander.

13. A tube expanding system as in claim 12 wherein the fluid is glycerin; and wherein said bladder means includes a distensible polyurethane bladder having a chamber, and sealing means for sealing said bladder to preclude the escape of fluid from the chamber thereof.

14. A tube expanding system as in claim 12 wherein said pump acts as a constant volume pump for incrementally decreasing the volume of the system exclusive of the hydraulic expander.

15. A tube expanding system as in claim 12 wherein said pump acts as a constant mass pump for incrementally increasing the mass of the system.

16. A tube expanding system as in claim 12 further comprising a computer programmed for receiving the pressure indication from said pressure sensing and indicating means, computing rate of system pressure change as a function of incremental pump action, and stopping the pump action upon sensing a decrease in said rate indicative of plastic expansion of the tube.

17. A tube expanding system as in claim 16 wherein said computer is programmed to allow a fixed number of further incremental actions by said pump after sensing said decrease in said rate whereby the tube is further expanded, and said computer program is effective to limit the tube diameter increase to no more than six thousandths of an inch after relaxation.

18. A tube expanding system as in claim 17 wherein said decrease in said rate follows a prior decrease in said rate indicative of the plastic expansion of a sleeve positioned within said tube and an increase in said rate indicating the onset of elastic expansion of said tube.

* * * * *